US011980931B2

(12) United States Patent
Yi et al.

(10) Patent No.: US 11,980,931 B2
(45) Date of Patent: May 14, 2024

(54) GUIDE ROLLER WITH INTEGRATED OPTICAL SENSORS AND CONTINUOUS CASTING MACHINE

(71) Applicant: AKTIEBOLAGET SKF, Gothenburg (SE)

(72) Inventors: Xing Yi, Shanghai (CN); Liang Weng, Hangzhou (CN); Jiakai Liu, Shanghai (CN); Weifei Geng, Shanghai (CN); Zongkang Xu, Suzhou (CN)

(73) Assignee: AKTIEBOLAGET SKF, Gothenburg (SE)

( * ) Notice: Subject to any disclaimer, the term of this patent is extended or adjusted under 35 U.S.C. 154(b) by 0 days.

(21) Appl. No.: 18/124,100

(22) Filed: Mar. 21, 2023

(65) Prior Publication Data

US 2023/0330741 A1 Oct. 19, 2023

(30) Foreign Application Priority Data

Apr. 13, 2022 (CN) ..... 202210386251.2

(51) Int. Cl.
*B22D 11/128* (2006.01)
*B22D 2/00* (2006.01)

(52) U.S. Cl.
CPC ..... *B22D 11/1287* (2013.01); *B22D 2/00* (2013.01)

(58) Field of Classification Search
CPC ..... B22D 2/00; B22D 11/128; B22D 11/1287
USPC ..... 164/441, 442, 447, 448, 151.2, 151.4
See application file for complete search history.

(56) References Cited

U.S. PATENT DOCUMENTS

2004/0055398 A1 3/2004 Weyer et al.
2008/0198900 A1* 8/2008 Myhre ..... B22D 11/225 374/208

FOREIGN PATENT DOCUMENTS

| | | | | |
|---|---|---|---|---|
| CN | 1204986 C | * | 6/2005 | ..... B22D 11/0622 |
| DE | 10039015 C1 | | 1/2002 | |
| DE | 102009060639 A1 | | 4/2011 | |
| DE | 102020200818 A1 | | 5/2021 | |
| JP | 2012130927 A | | 7/2012 | |
| NL | 1019602 C2 | | 6/2003 | |

OTHER PUBLICATIONS

Machine translation of CN 1204986 C (Year: 2005).*
Office Action from the Austrian Patent Office dated Oct. 10, 2023 in related application No. 4A A 50253/2023-1, and translation thereof.

* cited by examiner

*Primary Examiner* — Kevin P Kerns
(74) *Attorney, Agent, or Firm* — J-TEK LAW PLLC; Scott T. Wakeman; Mark A. Ussai

(57) ABSTRACT

A guide roller for a continuous casting machine includes a roller seat having bearings, a roller shaft mounted for rotation in the roller seat and at least one roller body mounted on the roller shaft and configured to support a billet. A passive optical sensor is mounted to the roller seat and configured to output optical signals, and an optical fiber extends from the passive optical sensor and is configured to convey the optical signals to a processor configured to determine one or more physical parameters of an installation position of the passive optical sensor based on the optical signals.

19 Claims, 5 Drawing Sheets

GUIDE ROLLER WITH INTEGRATED OPTICAL SENSORS AND CONTINUOUS CASTING MACHINE

CROSS-REFERENCE

This application claims priority to Chinese patent application no. 202210386251.2 filed on Apr. 13, 2022, the contents of which are fully incorporated herein by reference.

TECHNOLOGICAL FIELD

This disclosure relates a continuous casting machine, and, more specifically, to a guide roller of a continuous casting machine having integrated optical sensors.

BACKGROUND

A modern continuous casting machine is a highly automated system that includes a large number of sensors to continuously monitor relevant parameters of a continuous casting production process. However, guide rollers, which are important components of continuous casting machines are not provided with sensors. This makes it impossible to monitor health and actual working conditions of the guide rollers and/or to predict the service life of the guide roller, which makes the maintenance cost of the guide roller high. The working environment of the guide roll of a continuous caster is very bad with the complicated conditions such as high temperature, high load and heavy pollution. It would therefore be desirable to provide a low-cost, high-reliability guide roll monitoring system.

SUMMARY

The purpose of the present disclosure is to solve at least one of the drawbacks of the prior art, and to provide guide roller for a continuous casting machine that includes an integrated optical sensor, as well as a continuous casting machine that includes such a guide roller.

In a first aspect, the present disclosure provides a guide roller for a continuous casting machine comprising a roller shaft, a roller body, a roller seat and bearings. The roller body is configured to support a billet, and the roller shaft is mounted on a roller seat. A passive optical sensor is installed on the roller seat and is connected to a processor via an optical fiber. The processor determines one or more physical parameters at the installation position of the optical sensor based on optical signals collected by the optical sensor.

According to this solution, the physical parameters at the roller seat can be monitored online using the optical sensor integrated on the roller seat, and the working status and/or remaining service life of the guide rollers can be determined based on the physical parameters, thereby allowing for the detection and replacement of abnormal guide rollers in a timely manner and reducing maintenance costs. Furthermore, the present disclosure uses a passive optical sensor for monitoring, which sensor does not include conductive components and is not affected by adverse factors such as electromagnetic interference, high temperature, and vibration in the environment, thus enabling stable and reliable monitoring and providing accurate monitoring data.

Optionally, the optical sensor includes an optical temperature sensor for detecting a temperature at the installation position. The optical temperature sensor is installed on an upper portion of the roller seat close to the billet.

According to this solution, the optical temperature sensor is arranged in the upper portion of the roller seat which is most affected by the heat of billet so that the temperature change of the roller seat can be monitored accurately with high sensitivity.

Optionally, the optical temperature sensor is embedded in the roller seat from the side surface of the roller seat and is located between the position closest to the billet on the outer surface of the roller seat and the roller shaft. The optical fiber connected with the optical temperature sensor is arranged in a wiring slot extending in a lateral direction, a part of the optical fiber extends in the axial direction, and the other part of the optical fiber extends along the wiring slot in the lateral direction and finally leaves from the lower portion of the roller seat.

According to this solution, the optical temperature sensor is embedded into the roller seat, which is stably installed and can fully contact with the roller seat materials around it to improve the accuracy of temperature monitoring. Moreover, the lateral extending wiring slots are arranged for the optical fibers so that the optical fibers can be wired neatly.

Optionally, the side surface of the roller seat is provided with an axially extending stepped portion, a radially outer surface of the stepped portion is located radially inward of a radially outer surface of the roller seat, a lateral wall connects the radially outer surface of the stepped portion and the radially outer surface of the roller seat, and the optical temperature sensor is embedded into the roller seat through the lateral wall. The side surface of the roller body opposite to the side surface of the roller seat is provided with a concave portion (recess), and the stepped part and the transversely extending portion of the optical fiber connected with the optical temperature sensor extend into the concave portion.

According to this solution, the roller body can cover most portions of the transverse extension of the optical fiber and protect it from external interference.

Optionally, the roller seat comprises a main body and a side cover on one side of the main body, the optical temperature sensor is embedded into the main body from the side surface of the main body; a laterally open groove is formed on the side surface of the side cover at a position corresponding to the optical temperature sensor, and the side cover surrounds the optical fiber around the groove so that it will not be exposed to the outside; and/or a laterally open groove is formed on the side of the main body at a position corresponding to the optical temperature sensor, and the side cover covers the groove to surround the optical fiber so that it will not be exposed to the outside.

According to this solution, the side cover can completely cover the optical fiber and protect it from external interference.

Optionally, the optical sensor includes an optical load sensor for detecting the load at the installation position. An installation slot is formed on the bottom surface of the roller seat opposite to the roller body directly. The optical load sensor is arranged in the installation slot, and the optical fiber connected with the optical load sensor extends out from the installation slot in the axial direction.

According to this scheme, the optical load sensor is arranged on the bottom surface of the roller seat which bears the largest load near the middle part so that the load change of the roller seat can be monitored accurately and highly sensitively.

Optionally, the optical sensor includes an optical vibration sensor for detecting the vibration of the installation position. The optical load sensor is installed on the bottom or side surface of the roller seat.

According to this scheme, the optical vibration sensor can be installed conveniently.

Optionally, the optical sensor comprises an optical grease status sensor for detecting the health status of grease, and the optical grease status sensor is embedded into the roller seat in contact with the grease; and/or the guide roller further comprises an electronic grease status sensor for detecting the health status of grease, and the electronic grease status sensor is embedded into the roller seat and in contact with the grease.

According to this solution, the health status of grease can be detected online, and the failure of grease and the deterioration of guide roller can be found in time.

Optionally, the optical sensor is an integrated sensor with multiple parameter detection functions.

According to this disclosure, integrated sensors can be used to realize various parameter detection functions, improve system integration, and reduce and simplify optical fiber wiring.

In a second aspect of the present disclosure, there is provided a continuous casting machine, comprising: a cooling chamber including a roller array that supports and guides a billet to be transported forward, the roller array including a plurality of the above-mentioned guide rollers; a processor connected with optical sensors on each guide roller via optical fibers, wherein the processor determines one or more physical parameters of the installation position of the optical sensor based on optical signals obtained by the optical sensors, and determines the working status and/or remaining service life of the guide rollers based on the one or more physical parameters.

According to this arrangement, the optical sensor integrated on the guide roller can be used to determine the working status of the guide roller and/or predict the remaining service life of the guide roller so that the abnormal guide roller can be found and replaced in time and the maintenance cost can be reduced.

DETAILED DESCRIPTION

Figure 1:
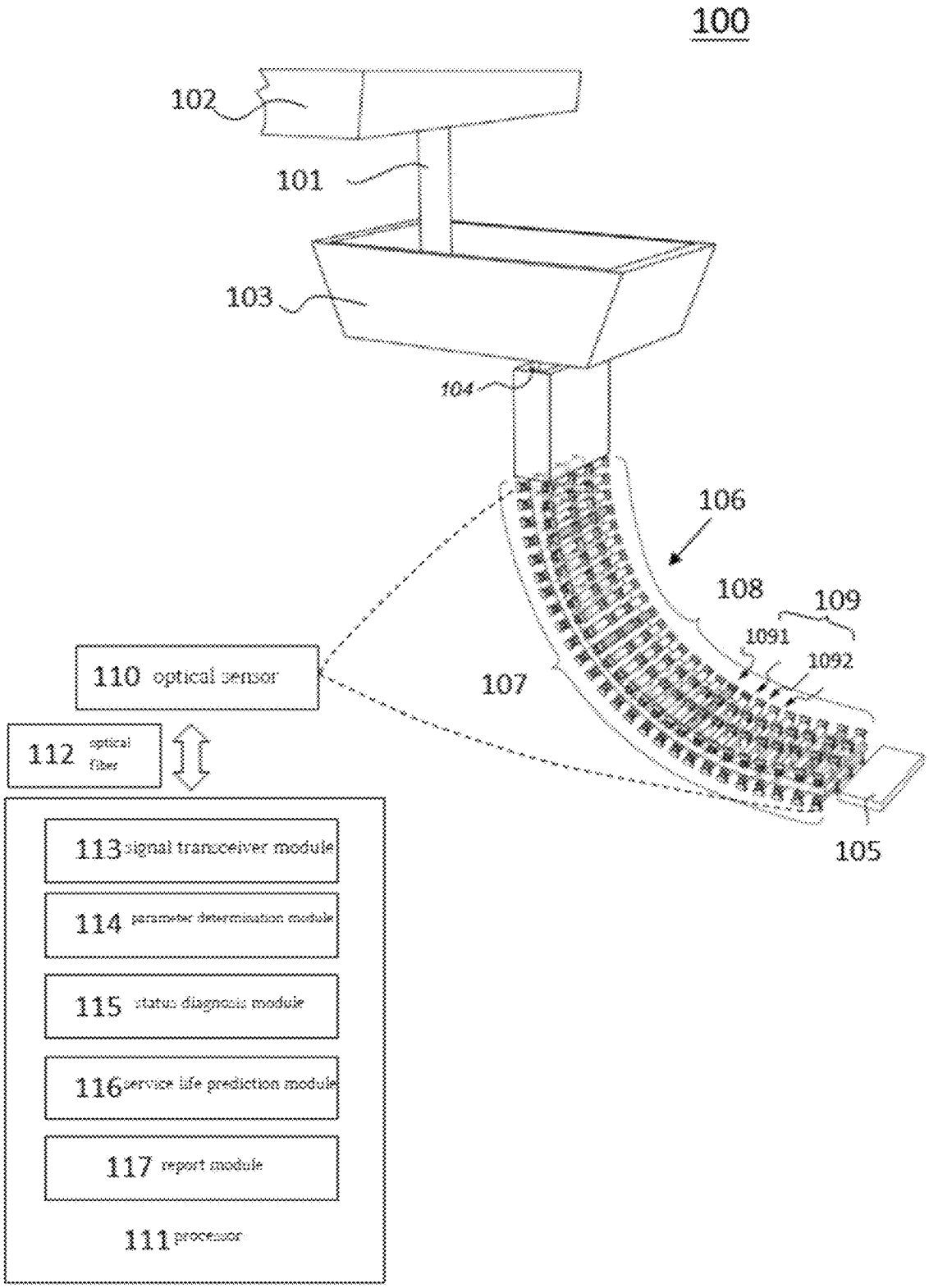
FIG. 1 is a schematic view of a continuous casting machine according to an embodiment of the present disclosure.

In order to make the purpose, scheme and advantages of the technical scheme of the present disclosure more clear, the technical scheme of the embodiment of the present disclosure will be described clearly and completely with the attached drawings of specific embodiments of the present disclosure. Unless otherwise specified, the terms used herein have their ordinary meaning in the art. The same reference numerals in the drawings represent the same components.

FIG. 1 shows a schematic view of a billet continuous casting machine 100 in which molten metal 101 is alloyed and degassed in a pouring ladle 102 and then transferred to a tundish 103. The tundish 103 regulates the flow of molten metal 101 and then discharges it to the top of a mold 104. The mold 104 is water-cooled to solidify molten metal that is in direct contact with the mold 104. In the mold 104, a thin layer of molten metal next to the mold wall solidifies (forms a shell) before the middle part of the volume of molten metal to form a billet 105 that leaves from the bottom of the mold 104 and enters a cooling chamber 106. In the cooling chamber 106, the billet 105 is supported from below by a lower roller array 107 and is abutted from above by an upper roller array 108. The billet 105 is transported forward along an arc trajectory, and at the same time, water is sprayed on the surface of the billet 105 to further cool it. The solidified billet 105 leaves from an outlet of the cooling chamber 106 and is cut and conveyed at the subsequent station. In some billet continuous casting machines, the lower roller array 107 is used without the upper roller array 108.

The lower roller array 107 and the upper roller array 108 each include a plurality of sector segments, and each sector segment includes a plurality of guide rollers 109 mounted on a movable frame (not shown). Among these guide rollers 109, a driving guide roller 1091 is coupled with a driving mechanism to drive the billet 105 to move forward, and a driven guide roller 1092 rotates with the movement of the billet 105.

The continuous casting machine 100 of the present disclosure integrates optical sensors 110 at one or more guide rollers 109 for the on-line monitoring of one or more characteristics of the physical performance of the guide rollers 109, thereby monitoring the working status of the guide rollers 109 and/or predicting the remaining service life of the guide rollers 109.

The optical sensor 110 is passive and is configured to emit a light beam near the installation position at which it is installed on the guide roller 109 and then receive a reflected light beam. Based on the characteristics of the reflected light beam, physical characteristics of the installation position such as temperature, vibration, load and the health status of the grease etc. can be obtained. The optical sensor 110 that can realize the above functions is well known in the prior art, so it will not be discussed in details.

The continuous casting machine 100 of the present disclosure includes a processor 111, which is optically connected to the optical sensor 110 on each guide roller 109 by an optical fiber 112. The processor 111 includes a signal transceiver module 113 that is used to send a light beam to the optical sensor 110 under the instruction of control command and is also used to receive and process the reflected light beam from the optical sensor 110 and convert the reflected light beam signal into an intermediate electrical signal. The parameter determination module 114 in the processor 111 determines physical parameters, such as temperature, vibration, load, grease health status, etc., based on the pre-stored calculation model, lookup table, etc., from the intermediate electrical signals. The status diagnosis module 115 in the processor 111 determines whether the working status of the corresponding guide roller 109 is in a healthy status or a fault status according to one or more physical parameters obtained based on the pre-stored calculation model, lookup table, etc. In addition, the processor 111 may also include a service life prediction module 116 that determines the remaining service life of the corresponding guide roller 109 according to the obtained one or more physical parameters based on the pre-stored calculation model, lookup table, etc. The report module 117 in the processor 111 reports the working status and/or remaining service life of the guide roller 109 to other equipment so that the operator of the continuous casting machine 100 or other processing equipment can know this information and take appropriate action.

In the present disclosure, the optical sensor 110 integrated in the guide roller 109 does not contain conductive connecting parts, i.e., it is non-electronic, so it will not be affected by electromagnetic fields, high temperatures and vibration in the environment and can work more stably and reliably than an electrical sensor. Moreover, optical sensors 110 and optical fibers 112 are arranged on hundreds of guide rollers 109 in the continuous casting machine 100, which has obvious cost advantages over the scheme of arranging electrical sensors and cables, and can use one single processor 111 to realize high-speed and high-flux calculation.

Figure 2:
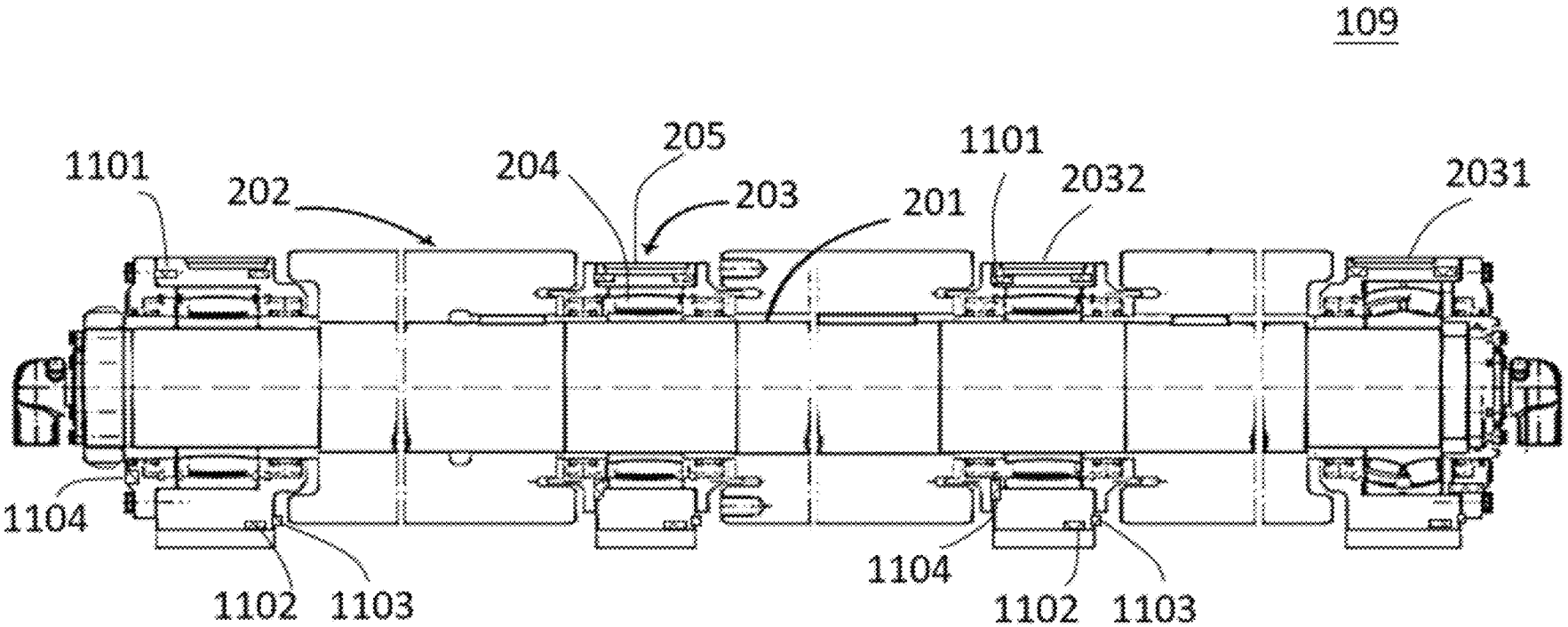
FIG. 2 is a schematic view of a guide roller of the continuous casting machine of FIG. 1.

FIG. 2 shows a schematic view of a common guide roller 109 integrated with an optical sensor 110 in the present disclosure. The guide roller 109 includes a roller shaft 201, a roller body 202, a roller seat 203 and bearings 204. A plurality of roller bodies 202 are fixedly mounted to the roller shaft 201, and they can rotate together, and the outer surfaces of the roller bodies 202 are used for contacting with the billet 105. The roller shaft 201 is mounted to the roller seat 203 at a plurality of positions via bearings 204, and the roller shaft 201 can rotate relative to the roller seat 203. The outer surface of the roller seat 203 is lower than that of the roller body 202, so the roller seat 203 does not contact the billet 105 when the roller body 202 supports the billet 105 to be transported. The upper surface of the roller seat 203 is very close to the billet 105, and the roller seat 203 and the bearing 204 inside the roller seat 203 will be affected by the high temperature (possibly 800-1000° C.) of the billet 105. For this reason, a coolant channel 205 is also provided in the roller seat 203 for cooling the roller seat 203, and the coolant channel 205 is surrounded by a groove and a baffle at the outer side of the roller seat 203. The guide roller 109 has a plurality of roller seats 203 to realize multi-point support, including outer roller seats 2031 located at the left and right ends of the guide roller 109 for supporting the roller shaft 201 and an inner roller seat 2032 for supporting the middle portion of the roller shaft 201. Lubricating grease is also contained in the roller seat 203 near the bearing 204. Here, "axial direction" refers to a direction parallel to the rotation axis of roller shaft 201, and "lateral direction" refers to a direction perpendicular to the rotation axis. In some guide rollers, the roller body and the roller shaft are integral parts. In other guide rollers, the roller shaft is fixedly installed on the roller seat, and the roller body is rotatably installed on the roller shaft through bearings. These different types of guide rollers are within the protection scope of the present disclosure.

Optical sensors 110 (1101, 1102, 1103, 1104) performing various functions are installed at different positions on the roller seat 203 and are discussed individually below.

An optical temperature sensor 1101 is installed on the upper portion of the roller seat 203 close to the billet 105. Preferably, the optical temperature sensor 1101 can be arranged between the position closest to the billet 105 on the outer surface of the roller seat 203 and the roller shaft 201, which has the highest temperature, and it is most effective to set the optical temperature sensor 1101 at this position to measure the temperature. In addition, an optical temperature sensor 1101 may be provided at other positions on the upper portion of the roller seat 203. The optical temperature sensor 1101 is embedded into a side surface of the roller seat 203. This embedded installation makes the optical temperature sensor 1101 firmly installed and difficult to fall off, and it can fully contact with the material of the roller seat 203 and keep away from the coolant channel 205 inside the roller seat 203, thus improving the temperature measurement accuracy. In addition, the end of the optical temperature sensor 1101 can be fastened to the side surface of the roller seat 203 by using threads to further fasten the optical temperature sensor 1101 and prevent it from being accidentally detached when in use. Optical temperature sensors 1101 may be embedded in the left and right sides of the roller seat 203. According to requirements, a plurality of optical temperature sensors 1101 can be installed on the roller seat 203 to realize multi-point measurement. In addition, a wiring slot 206 extending in the lateral direction for wiring the optical fiber 112 is formed on the side surface of the roller seat 203, and the width of the wiring slot 206 is suitable for the optical fiber 112 to be smoothly bent by 90 degrees. The optical fiber 112 can extend in the lateral direction along the wiring slot 206 and finally extend away from the lower portion of the roller seat 203.

Figure 3:
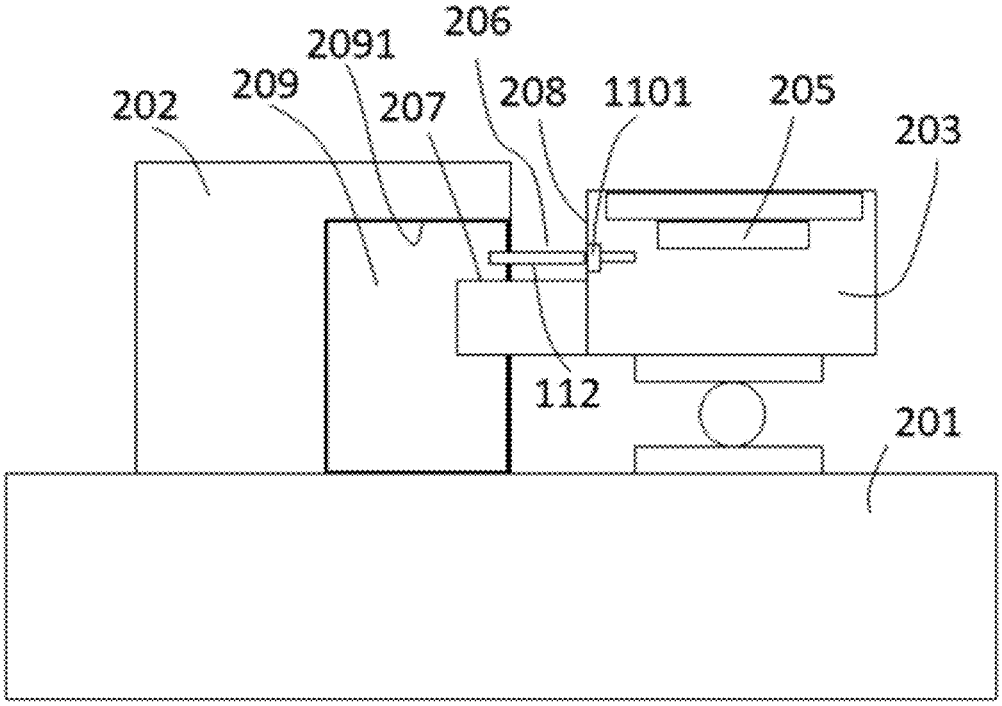
FIG. 3 is a schematic view of a first installation mode of an optical temperature sensor according to an embodiment of the present disclosure.
Figure 4:
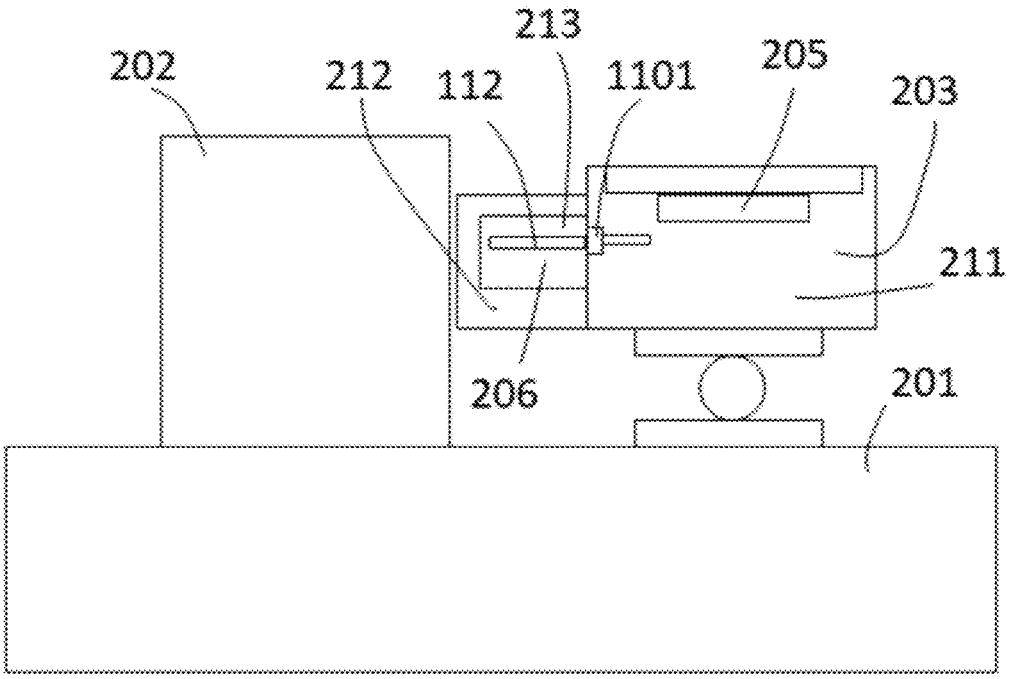
FIG. 4 is a schematic view of a second installation mode of an optical temperature sensor according to an embodiment of the present disclosure.

FIGS. 3 and 4 show two different installation modes of the optical temperature sensor 1101.

In the embodiment of FIG. 3, the side surface of the roller seat 203 has a stepped portion 207 extending axially, and the outer surface of the stepped portion 207 is lower than the outer surface of the roller seat 203. A vertical wall 208 connects the outer surface of the stepped portion 207 and the outer surface of the roller seat 203, and an optical temperature sensor 1101 is embedded in the vertical wall 208. In addition, the side surface of the roller body 202 opposite to the side surface of the roller seat 203 has a concave portion 209, and the step portion 207 and the optical fiber 112 can partially extend into the concave portion 209 without contacting with the roller body 202. At this time, an inner wall 2091 of the concave portion 209, the outer surface of the stepped portion 207 and the vertical wall 208 of the roller seat 203 enclose the wiring slot 206 wherein the optical fiber 112 is arranged. Most portions of the optical fiber 112 extending in the lateral direction is shielded by the inner wall 2091 of the concave portion 209, and only a small portion extending in the axial direction is exposed to the outside. This arrangement can greatly protect the optical fiber 112 from external interference.

Figure 5:
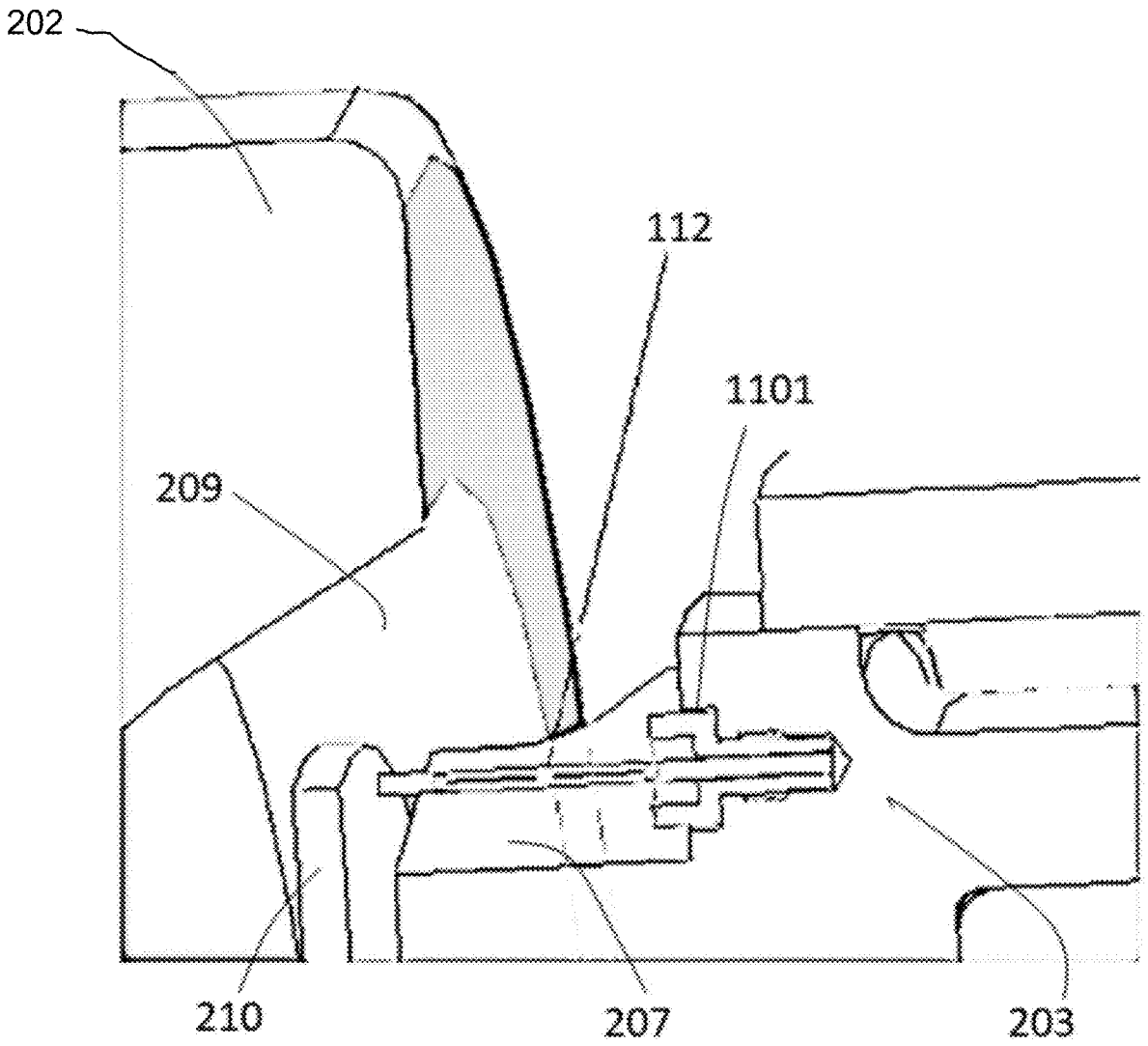
FIG. 5 is a partial sectional view of the first installation mode of an optical temperature sensor according to an embodiment of the present disclosure.

In addition, as shown in the partial cross-sectional view of FIG. 5, a limit plate 210 can also be arranged at a position which is close to the side surface of the stepped portion 207. The limit plate 210 is installed and fixed at one side of the roller seat 203, and the outer edge of the limit plate 210 is higher than that of the optical fiber 112, which can prevent the optical fiber 112 from contacting the roller body 202, thus improving the reliability of wiring. Advantageously, the optical fiber 112 can extend downward through the gap between the limit plate 210 and the stepped portion 207, and the limit plate 210 can limit the position of the optical fiber 112 so that it will not be easily separated from the installation position.

In the embodiment of FIG. 4, the roller seat 203 comprises a main body 211 and a side cover 212 on one side of the main body 211, and the optical temperature sensor 1101 is embedded into the main body 211 from the side surface of the main body 211. On the side surface of the side cover 212, a laterally open groove 213 is formed at the position corresponding to the optical temperature sensor 1101, and the groove 213 forms a wiring slot 206 for wiring the optical fiber 112. In this embodiment, the side cover 212 surrounds the optical fiber 112 around the groove 213 so that it will not be exposed to the outside at all. This arrangement can protect the optical fiber 112 from external interference. Moreover, the side cover 212 can completely prevent the optical fiber 112 from tilting and interfering with surrounding moving parts (such as the roller body 202 and the billet 105). In another embodiment, a laterally open groove is formed on the side surface of the main body 211 at a position corresponding to the optical temperature sensor 1101, which forms a wiring slot 206 for wiring the optical fiber 112, and the side cover 212 closes the groove to surround the optical fiber 112 so that it will not be exposed to the outside at all. The above two embodiments can be combined, that is, grooves are arranged on the side surface of the main body 211 and the side surface of the side cover 212, and the optical fiber 112 is arranged in the wiring slot formed by the combination of these two grooves, so as to be isolated from the outside.

Figure 6:
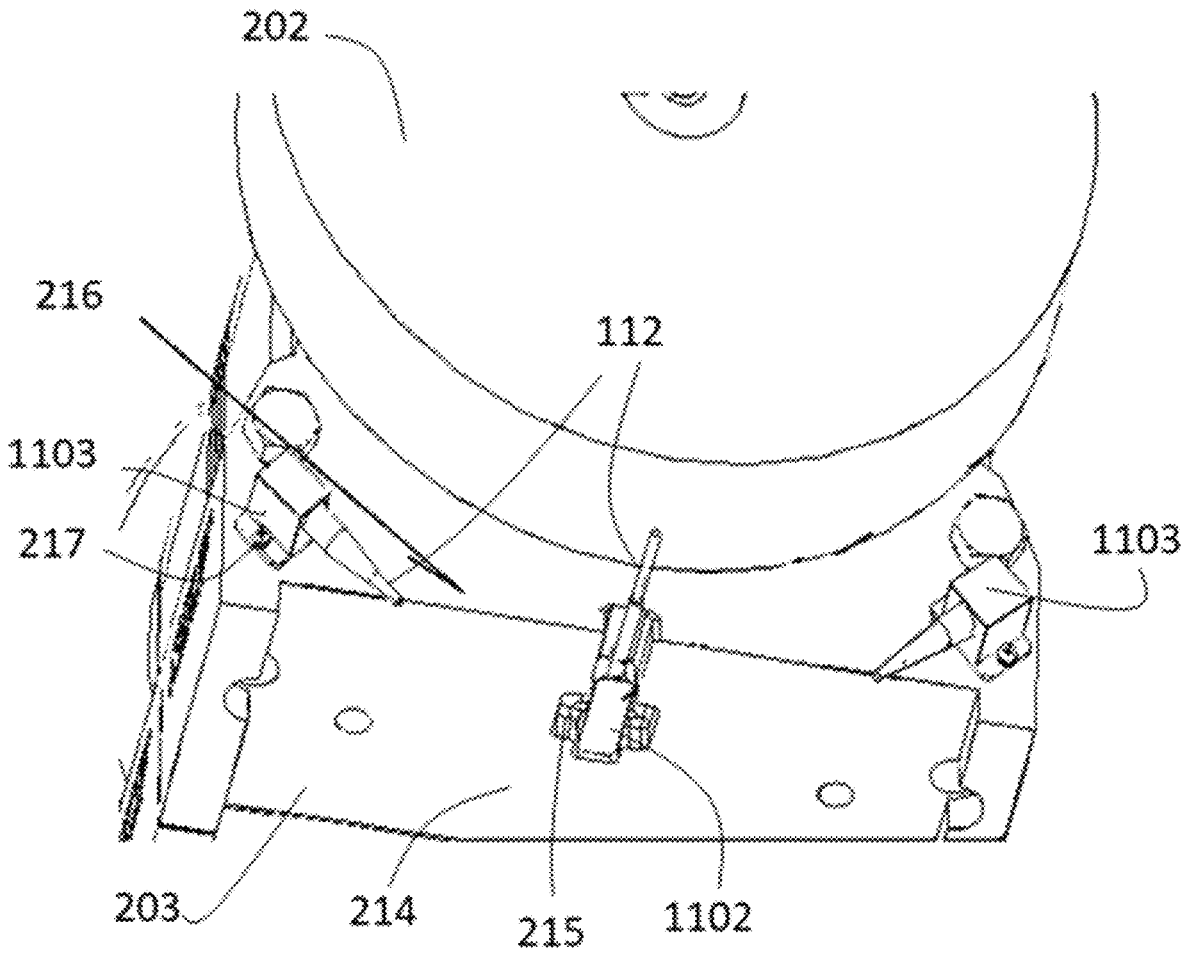
FIG. 6 is a perspective view of the bottom of a roller seat that supports the guide roller of FIG. 2.

An optical load sensor 1102 is installed at the lower portion of the roller seat 203 on the side away from the billet 105. Preferably, the optical load sensor 1102 can be arranged at the middle position of the bottom surface of the roller seat 203, where the load is the largest, and it is most effective to set the optical load sensor 1102 at this position for measurement. As shown in FIG. 6, an installation slot 215 is formed at the position where the bottom surface 214 of the roller seat 203 faces the roller body 202 directly. The optical load sensor 1102 is welded in the installation slot 215, and the optical fiber 112 connected with the optical load sensor 1102 extends out from the installation slot 215 in the axial direction. In addition to welding, the optical load sensor 1102 may be mounted by screw connection, bonding, etc. The optical fiber 112 is located directly below the roller body 202 and protected by the roller body 202 from external interference. In addition, the optical load sensor 1102 may be provided at other positions of the lower portion of the roller seat 203. A plurality of optical load sensors 1102 can be installed on the roller seat 203 as required to realize multi-point measurement. In addition, the optical load sensor 1102 may be provided on the side surface of the roller seat 203. The optical load sensor 1102 can directly determine the magnitude of the load at the installation position based on the optical signal. It is also possible to determine the stress or strain at the installation position based on the optical signal, and then determine the magnitude of the load at the installation position based on the stress or strain.

An optical vibration sensor 1103 is installed at the lower portion of the roller seat 203 on the side away from the billet 105. Preferably, the optical load sensor 1103 may be arranged on the side surface of the bottom of the roller seat 203. As shown in FIG. 6, on the side surface 216 of the bottom of the roller seat 203, two optical vibration sensors 1103 are mounted by screws 217 at two positions symmetrical about the optical load sensor 1102. The optical fiber 112 connected to the optical vibration sensor 1103 extends obliquely downward and inward. The optical vibration sensor 1103 can be mounted by welding, bonding, etc. in addition to the threaded connection. The distance between the installation position of the optical vibration sensor 1103 on the side surface 216 and the bottom surface 214 is set so that the optical fiber 112 can smoothly transition to a horizontal state without obvious bending. In addition, the optical vibration sensor 1103 may be provided at other positions of the lower portion of the roller seat 203. A plurality of optical load sensors 1103 can be installed on the roller seat 203 as required to realize multi-point measurement.

An optical grease status sensor 1104 can be installed through the roller seat 203 and contact with lubricant grease near the bearing 204. As shown in FIG. 2, the optical grease status sensor 1104 can be embedded inside the roller seat 203 through the side surface of the roller seat 203 in the axial direction, or can be embedded inside through the bottom surface of the roller seat 203 in the direction perpendicular to the axial direction. In addition, the guide roller 109 can also include an electronic grease status sensor, which can also be arranged to be installed through the roller seat 203 and contact with the lubricant grease near the bearing 204.

In some embodiments, an integrated sensor with multiple parameter detection functions can be used, for example, a temperature-vibration integrated sensor, a temperature-load integrated sensor, a load-vibration integrated sensor and the like. The use of integrated sensors can improve the system integration, reduce wiring and simplify the system structure.

In some embodiments, different numbers of optical sensors 110 are arranged at different roller seats 203 of the same guide roller 109 to adapt to different working conditions at different roller seats 203. For example, there are more optical temperature sensors 1101 at the inner roller seat 2032 than at the outer roller seat 2031 to more accurately detect the temperature at the inner roller seat 2032, which is usually higher in temperature and more likely to fail.

In some embodiments, different numbers of optical sensors 110 are arranged at different guide rollers 109 of the same continuous casting machine 100 to adapt to different working conditions at different guide rollers 109. Referring to FIG. 1, the guide roller 109 at the entrance of the cooling chamber 106 can be provided with more optical sensors than the guide roller 109 at the exit of the cooling chamber 106, so as to more accurately detect various physical parameters of the guide roller 109 which is more likely to fail due to higher temperature at the entrance of the cooling chamber 106. More optical sensors can be provided at the driving guide roller 1091 than at the driven guide roller 1092, so as to more accurately detect various physical parameters of the driving guide roller 1091 which are more likely to fail due to higher load. More optical sensors can be provided at the guide roller 109 in the sector segment with greater change in casting radius curvature than at the guide roller 109 in the sector segment with smaller change in casting radius curvature, so as to more accurately detect various physical parameters at the guide roller 109 which is usually subject to higher load and is more likely to failure. It is also possible to arrange more optical sensors at the guide roller 109 at the entrance and/or exit of each sector segment than the guide roller 109 at the middle part of the sector segment, so as to more accurately detect various physical parameters of the guide roller 109 at the entrance and/or exit that are more vulnerable to abnormal working conditions. In addition, more optical sensors can be arranged at other guide rollers 109 that are more vulnerable to abnormal working conditions or more concerned, so as to detect its physical parameters more accurately.

Exemplary embodiments of the present disclosure have been described in detail herein with reference to preferred embodiments. However, those skilled in the art can understand that various variations and modifications can be made to the above specific embodiments without departing from the inventive concept, and various technical features and structures proposed by the present disclosure can be combined in various ways without exceeding the scope of protection of the present disclosure, which is determined by the appended claims.

The processor disclosed herein may be formed by a computer processor (CPU=central processing unit), an application-specific integrated circuit (ASIC), an integrated circuit (IC), a computer, a system-on-a-chip (SOC), a programmable logic element, or a field programmable gate array (FGPA) including a microprocessor.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved guide rollers for continuous casting machines.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

REFERENCE NUMERALS

100 continuous casting machine
101 molten metal
102 pouring ladle
103 tundish
104 mold
105 billet
106 cooling chamber
107 lower roller array
108 upper roller array
109 guide roller
1091 driving guide roller
1092 driven guide roller
110 optical sensor
111 processor
112 optical fiber
113 signal transceiver module
114 parameter determination module
115 status diagnosis module
116 service life prediction module
117 report module
1101 optical temperature sensor
1102 optical load sensor
1103 optical vibration sensor
1104 optical grease status sensor
201 roller shaft
202 roller body
203 roller seat
204 bearing
205 coolant channel
206 wiring slot
207 stepped portion
208 vertical wall
209 concave portion
210 limit plate
211 main body
212 side cover
213 groove
214 bottom surface
215 installation slot
216 side surface
217 screw

What is claimed is:

1. A guide roller for a continuous casting machine, comprising:

a roller seat including bearings;

a roller shaft mounted for rotation in the roller seat and supporting at least one roller body, the at least one roller body being configured to support a billet, a passive optical sensor mounted to the roller seat and configured to output optical signals, an optical fiber extending from the passive optical sensor and configured to convey the optical signals to a processor configured to determine one or more physical parameters of an installation position of the passive optical sensor based on the optical signals, wherein an outer surface of the at least one roller body is located a first radial distance from an axis of rotation of the shaft, wherein a maximum radial distance from the axis of rotation of the shaft to the passive optical sensor is less than the first distance, and wherein at least a portion of the passive optical sensor is located axially between the roller seat and the at least one roller body.

2. The guide roller according to claim 1, wherein:

the passive optical sensor comprises an optical temperature sensor for detecting a temperature of the installation position, and the optical temperature sensor is installed on an upper portion of the roller seat between the roller shaft and the billet.

3. The guide roller according to claim 1, wherein:

the passive optical sensor comprises an optical load sensor for detecting a load at the installation position;

a radially outer surface of a portion of the roller seat opposite the billet includes a slot the optical load sensor is arranged in the slot, and the optical fiber sensor extends out from the slot in the axial direction.

4. The guide roller according to claim 1, wherein:

the passive optical sensor comprises an optical vibration sensor for detecting the vibration of the installation position, and the optical load sensor is installed on the lateral surface of the roller seat or on a radially outer surface of a portion of the roller seat opposite the billet.

5. The guide roller according to claim 1, wherein:

the bearings are lubricated by a grease, the passive optical sensor comprises an optical grease status sensor for detecting a health status of the grease, and the optical grease status sensor is embedded inside the roller seat in contact with the grease.

6. The guide roller according to claim 1, wherein:

the bearings are lubricated by a grease, and an electronic grease status sensor for detecting a health status of the grease is embedded inside the roller seat in contact with the grease.

7. The guide roller according to claim 1, wherein:

the optical sensor is an integrated sensor with multiple parameter detection functions.

8. The guide roller according to claim 1, wherein the passive optical sensor is configured to emit a first light beam near an installation position of the passive optical sensor and to receive a reflected second light beam.

9. The guide roller according to claim 1, wherein the passive optical sensor comprises an optical temperature sensor, wherein the roller seat has a radially outer surface and a lateral side surface facing an axial end of the at least one roller body, and wherein the optical temperature sensor is embedded in the lateral side surface.

10. The guide roller according to claim 1, wherein the passive optical sensor comprises an optical temperature sensor.

11. A continuous casting machine, comprising:

a cooling chamber comprises an array of guide rollers according to claim 1, the guide rollers being configured to support and guide a billet, and the processor.

12. TA guide roller for a continuous casting machine, comprising:

a roller seat including bearings;

a roller shaft mounted for rotation in the roller seat and supporting at least one roller body, the at least one roller body being configured to support a billet, a passive optical sensor mounted to the roller seat and configured to output optical signals, and an optical fiber extending from the passive optical sensor and configured to convey the optical signals to a processor configured to determine one or more physical parameters of an installation position of the passive optical sensor based on the optical signals, wherein:

the passive optical sensor comprises an optical temperature sensor for detecting a temperature of the installation position, the roller seat has a radially outer surface and a lateral side surface perpendicular to an axis of rotation of the roller shaft, the optical temperature sensor is embedded in the lateral side surface at a location between a portion of the radially outer surface of the roller seat closest to the billet and the roller shaft, and the optical fiber extends out of the lateral side surface into a gap between the roller seat and one of the at least one roller body.

13. The guide roller according to claim 12, wherein:

the lateral side surface of the roller seat includes an axially extending stepped portion, a radially outer surface of the stepped portion is located radially inward of the radially outer surface of the roller seat, the lateral side surface connects the radially outer surface of the stepped portion and the radially outer surface of the roller seat, a lateral side surface of the at least one roller body opposite the lateral side surface of the roller seat includes a recess, and the stepped portion and the optical fiber extend into the recess.

14. The guide roller according to claim 12, wherein:

the roller seat comprises a main body having the lateral side surface and a cover mounted to the lateral side surface, a laterally open groove is formed on the side surface of the side cover at a position corresponding to the optical temperature sensor, and the side cover surrounds the optical fiber around the groove so that it will not be exposed to the outside; and/or a laterally open groove is formed on the side of the main body at a position corresponding to the optical temperature sensor, and the side cover covers the groove to surround the optical fiber so that it will not be exposed to the outside.

15. The guide roller according to claim 12, wherein:

the roller seat comprises a main body having the lateral side surface and a cover mounted to the lateral side surface, and the cover covers at least the first portion of the optical fiber.

16. The guide roller according to claim 12, wherein a first portion of the optical fiber extends axially away from the roller seat into a wiring slot and a second portion of the optical fiber extends radially away from the axis of rotation.

17. A guide roller for a continuous casting machine, comprising:

a roller seat including bearings;

a roller shaft mounted for rotation in the roller seat and supporting at least one roller body, the at least one roller body being configured to support a billet, a passive optical sensor mounted to the roller seat and configured to output optical signals, an optical fiber extending from the passive optical sensor and configured to convey the optical signals to a processor configured to determine one or more physical parameters of an installation position of the passive optical sensor based on the optical signals, wherein the at least one roller body comprises a first roller body and a second roller body, and wherein the passive optical sensor is located axially between the first roller body and the second roller body.

18. The guide roller according to claim 17, wherein the passive optical sensor comprises an optical temperature sensor.

19. The guide roller according to claim 18, wherein a lateral side of the roller seat faces an axial end of the first roller body, and wherein the optical temperature sensor is embedded in the lateral side.

* * * * *